US007407047B2

(12) United States Patent
Yamagishi et al.

(10) Patent No.: US 7,407,047 B2
(45) Date of Patent: Aug. 5, 2008

(54) DISK-SHAPED OBJECT SORTER

(75) Inventors: Ryoji Yamagishi, Saitama (JP); Yukio Ito, Saitama (JP); Yasuyuki Furusawa, Saitama (JP)

(73) Assignee: Kabushiki Kaisha Nippon Conlux, Saitama (JP)

( * ) Notice: Subject to any disclaimer, the term of this patent is extended or adjusted under 35 U.S.C. 154(b) by 262 days.

(21) Appl. No.: 10/556,169

(22) PCT Filed: May 11, 2004

(86) PCT No.: PCT/JP2004/006257

§ 371 (c)(1),
(2), (4) Date: Nov. 7, 2005

(87) PCT Pub. No.: WO2004/100086

PCT Pub. Date: Nov. 18, 2004

(65) Prior Publication Data

US 2007/0000749 A1 Jan. 4, 2007

(30) Foreign Application Priority Data

May 12, 2003 (JP) ..... 2003-133206

(51) Int. Cl.
*G07D 5/02* (2006.01)

(52) U.S. Cl. ..... 194/335; 194/203; 194/337; 453/51; 209/656

(58) Field of Classification Search ..... 194/203, 194/232–236, 335, 337, 338, 339, 340, 345, 194/346, 353; 453/50, 51, 63; 193/DIG. 1; 209/656, 657
See application file for complete search history.

(56) References Cited

U.S. PATENT DOCUMENTS

| | | | | |
|---|---|---|---|---|
| 3,712,440 | A * | 1/1973 | Greenwald | 194/235 |
| 4,741,427 | A * | 5/1988 | Choderker et al. | 194/335 |
| 5,427,219 | A | 6/1995 | Kotler | |
| 6,076,650 | A * | 6/2000 | Schwarzli | 194/292 |

FOREIGN PATENT DOCUMENTS

| | | |
|---|---|---|
| DE | 4437813 A1 | 4/1996 |
| JP | 50-7495 | 1/1975 |
| JP | 53-4994 | 1/1978 |
| JP | 61-220089 | 9/1986 |
| JP | 39-21286 | 9/1989 |
| JP | 08-024434 | 1/1996 |
| JP | 2001-155207 | 6/2001 |

* cited by examiner

*Primary Examiner*—Joseph C Rodriguez
(74) *Attorney, Agent, or Firm*—Fish & Richardson P.C.

(57) ABSTRACT

Disk-shaped object thickness-restricting means is provided in a disk-shaped object guiding path for transferring a disk-shaped object, inserted through a disk-shaped object slot, in an inclined direction. The disk-shaped object thickness-restricting means comes into contact with the inserted disk-shaped object and changes its position depending on the thickness of the disk-shaped object in the contact, restricting the thickness of the inserted disk-shaped object.

1 Claim, 7 Drawing Sheets

DISK-SHAPED OBJECT SORTER

TECHNICAL FIELD

The present invention relates to a disk-shaped object sorter for determining the authenticity of a disk-shaped object such as a coin, a substitute for coins (a token), or a game medal, and sorting the disk-shaped object.

BACKGROUND

Disk-shaped object sorters have been provided in automatic vending machines and game mechanisms such as slot machines in order to verify the authenticity of disk bodies (coins or game medals and the like) inserted through a disk-shaped object slot, accept the disk bodies that are confirmed to be genuine, and return the disk bodies that are confirmed to be false.

FIG. 9 is a conceptual front view of a main portion of a conventional disk-shaped object sorter; it shows the vicinity of a disk-shaped object slot 2.

The disk-shaped object sorter 1 comprises a first disk-shaped object guiding path 3 for guiding downward a disk-shaped object inserted into a disk-shaped object slot 2 and a second disk-shaped object guiding path 5 connected to the downstream end of the first disk-shaped object guiding path 3 and composed of one inclined transfer rail 4 for guiding the inserted disk-shaped object in the direction inclined to the right, as shown in the figure. The reference symbol 13 in FIG. 9 stands for disk-shaped object detection means for measuring the authenticity of the disk-shaped object or the number of the disk bodies that have passed.

As shown in FIG. 10, which is a cross-sectional view along AA in FIG. 9, the first and second disk-shaped object guiding paths 3, 5 comprise a main plate 6 and a gate plate 7 for opening and closing the surface of the main plate 6.

On the other hand, as shown in FIG. 10, disk-shaped object thickness restricting means 8 for verifying the authenticity of the disk-shaped object by restricting the thickness of the inserted disk-shaped object is provided in the first disk-shaped object guiding path 3.

The conventional thickness-restricting means 8 comprises a thickness screw 9 provided in the main plate 6. The thickness screw 9 is provided in a condition of protruding, from the surface of the main plate 6, toward inside the first disk-shaped object guiding path 3, thereby restricting the thickness of the disk-shaped object falling down inside the first disk-shaped object guiding path 3 in the gap between the rear surface of the gate plate 7 and the distal end of the thickness screw 9. The gap between the distal end of the thickness screw 9 and the rear surface of the gate plate 7 opposite thereto is set to be almost equal to or slightly larger than the thickness of the genuine disk-shaped object.

With such a thickness-restricting means 8, as shown in FIG. 11, if the thickness of the inserted disk-shaped object 10 is equal to or less than the thickness of the genuine disk-shaped object, the disk-shaped object passes through the thickness-restricting means 8 and is guided by the second disk-shaped object guiding path 5 located downstream of the thickness-restricting means.

On the other hand, as shown in FIG. 12, when the thickness of the inserted disk-shaped object 11 is larger than the thickness of the genuine disk-shaped object, the disk-shaped object comes into contact with the distal end of the thickness screw 9 of the thickness-restricting means 8.

As a result, the disk-shaped object 11 having a thickness larger than that of the genuine disk-shaped object stops between the distal end of the thickness screw 9 and the rear surface of the gate plate 7, thereby preventing the disk-shaped object 11 having a thickness larger than the specified thickness from being inserted.

If the gate plate 7 is moved in the direction of arrow B with respect to the main plate 6 and opened, the disk-shaped object 11 with a thickness above the specified thickness that was stopped between he distal end of the thickness screw 9 and the rear surface of the gate plate 7 will fall down as shown by arrow C and will be rejected and returned.

The reference numeral 15 in FIG. 9 and FIG. 10 denotes well-known disk-shaped object outer diameter sorting means formed in the second disk-shaped object guiding path 5 for sorting the disk bodies according to the difference in the outer diameter thereof. This disk-shaped object outer diameter sorting means 15, as shown in FIG. 10, comprises a notch 7*a* formed in the gate plate 7 and an inclined surface 7*b*.

SUMMARY

The present invention provides a disk-shaped object sorter such that when a disk-shaped object with a thickness larger than that of the genuine disk-shaped object is inserted with force into a disk-shaped object slot, this disk-shaped object having a large thickness can be more reliably restricted.

DETAILED DESCRIPTION

Figure 12:
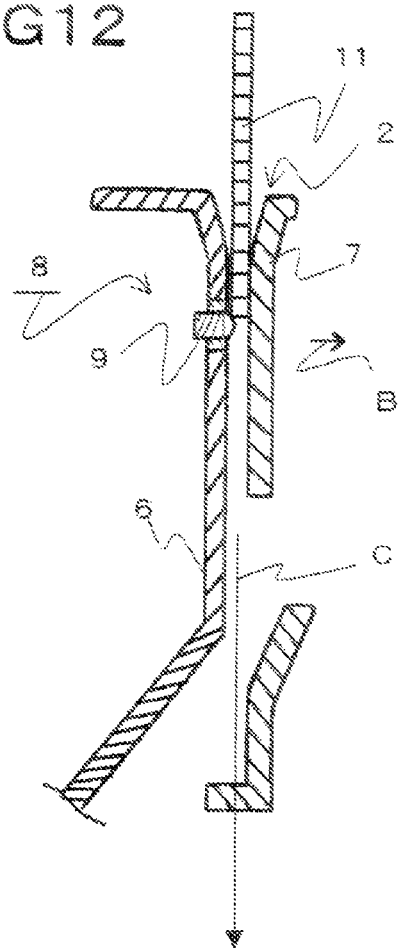
Prior Art FIG12
FIG. 12 is a conceptual cross-sectional view along AA is FIG. 9 illustrating the operation of the conventional disk-shaped object sorter.
Figure 13:
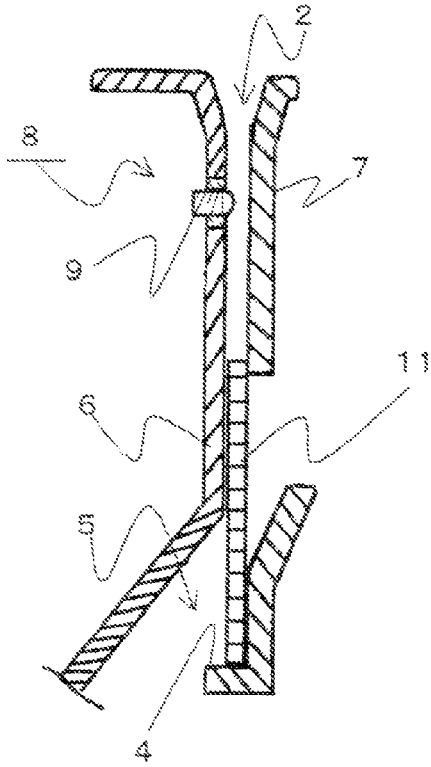
Prior Art FIG13
FIG. 13 is a conceptual cross-sectional view along AA in FIG. 9 illustrating the operation of the conventional disk-shaped object sorter.

With the above-described conventional disk-shaped object sorter 1, as shown in FIG. 12, when the thickness of the inserted disk-shaped object 11 is larger than the thickness of the genuine disk-shaped object, the disk-shaped object comes into contact with the distal end of the thickness screw 9 of the thickness-restricting means 8 and, therefore, stops between the distal end of the thickness screw 9 and the rear surface of the gate plate 7. The disk-shaped object is then removed by opening the gate plate 7. However, if the disk-shaped object 4 is inserted with force into the disk-shaped object slot 2 and the disk-shaped object 11 strongly collides with the gate plate 7, causing vibrations of the gate plate 7 and thereby slightly expanding the gap between the distal end of the thickness screw 9 and the rear surface of the gate plate 7, then the disk-shaped object 11 with a large thickness that has to be stopped by the distal end of the thickness screw 9 will pass through the gap between the distal end of the thickness screw 9 and the rear surface of the gate plate 7, will move onto the inclined transfer rail 4, as shown in FIG. 13, will be transferred to the second disk-shaped object guiding path 5, and will be handled as a genuine disk-shaped object.

DISCLOSURE OF THE INVENTION

With the foregoing in view, the disk-shaped object sorter in accordance with the present invention comprises a disk-shaped object guiding path which transfers and guides a disk-shaped object inserted through a disk-shaped object slot; a guide supported so as to freely swing in the disk-shaped object guiding path; impelling means for impelling the guide to apply pressure with the guide to one side surface of the disk-shaped object passing through the disk-shaped object guiding path; and stopper means for restricting expansion of a gap between a side wall of the disk-shaped object guiding path and the guide by coming into contact with the guide when a disk-shaped object with a thickness larger than a specified thickness advances, and stopping the advancement of the disk-shaped object with a thickness larger than the specified thickness.

As described above, the disk-shaped object sorter 20 in accordance with the present invention comprises a disk-shaped object guiding path 5 for transferring and guiding a disk-shaped object inserted through a disk-shaped object slot 2, a guide 33 supported, so that it is free to swing, in the disk-shaped object guiding path 5, impelling means 34 for impelling the guide in order to apply pressure with the guide 33 to one side surface of the disk-shaped object passing through the disk-shaped object guiding path 5, and stopper means 35 for restricting the expansion of a gap between a side wall of the disk-shaped object guiding path and the guide 33 by coming into contact with the guide when a disk-shaped object with a thickness larger than a specified thickness advances and stopping the advancement of the disk-shaped object with a thickness larger than the specified thickness. As a result, it is possible to provide a disk-shaped object sorter in which the energy of the disk-shaped object that was inserted with force and moves vigorously is absorbed by the guide 33 that changes the position of the disk-shaped object and, therefore, a mistake in restricting the thickness of the disk-shaped object that is an object of restriction and is guided to the downstream of the disk-shaped object guiding path 5, which is due to a vigorous movement of the disk-shaped object that was inserted with force, is effectively prevented and stable disk-shaped object sorting accuracy is maintained.

An embodiment of the disk-shaped object sorter in accordance with the present invention will be described below in greater detail.

Figure 1:
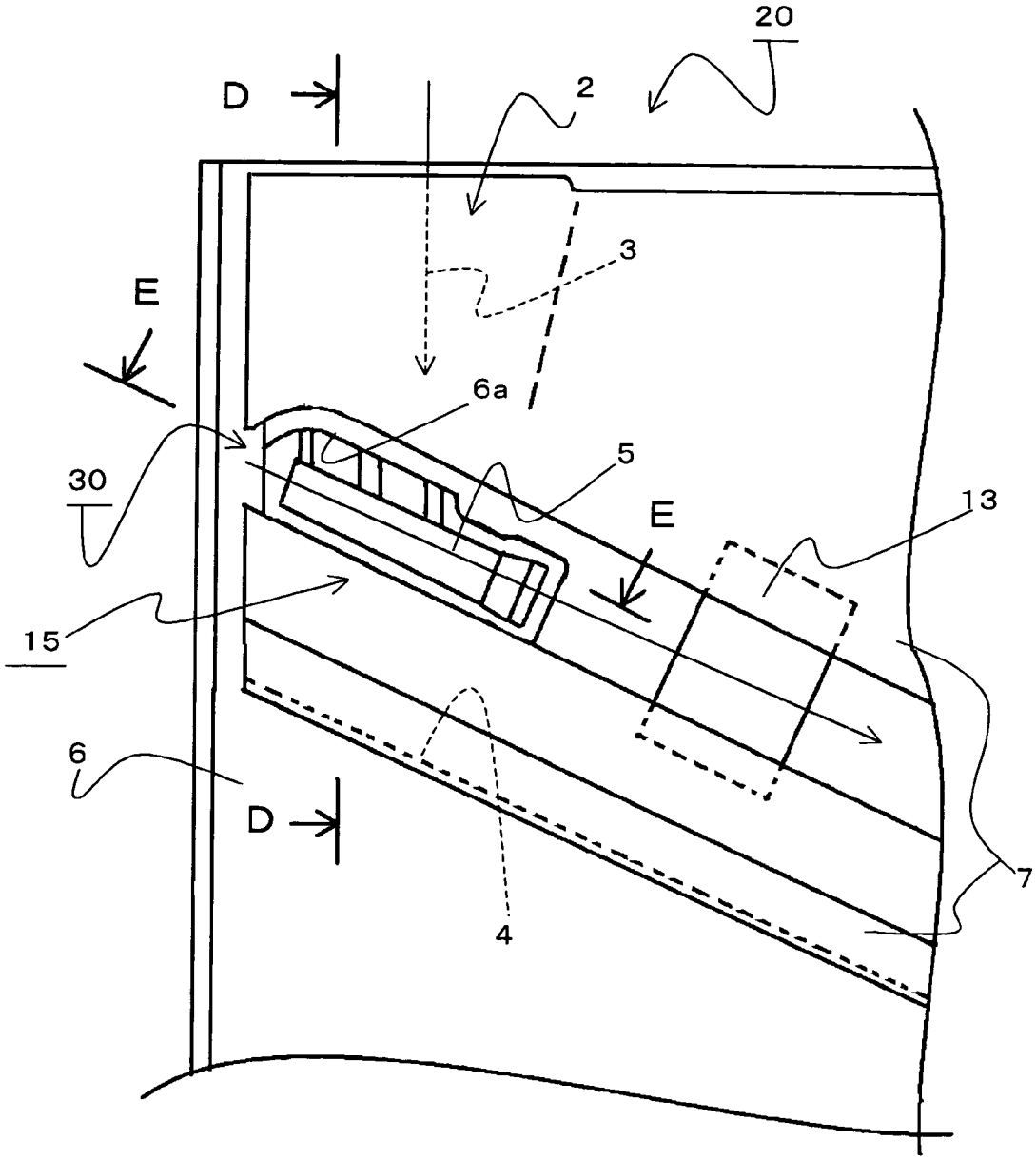
FIG. 1 is a conceptual front view of main portion of the disk-shaped object sorter in accordance with the present invention.

FIG. 1 is a conceptual front view of a main portion of a disk-shaped object sorter 20 in accordance with the present invention. In this figure, components identical to those shown in FIGS. 9 to 13 are represented by identical symbols.

The disk-shaped object sorter 20, similarly to the conventional sorter, comprises a first disk-shaped object guiding path 3 for guiding downward a disk-shaped object inserted into a disk-shaped object slot 2 and a second disk-shaped object guiding path 5 connected to the downstream end of the first disk-shaped object guiding path 3 and composed of an inclined transfer rail 4 for guiding the inserted disk-shaped object in the direction inclined to the right, as shown in the figure.

On the other hand, in this disk-shaped object sorter 20, disk-shaped object thickness-restricting means 30 for determining the authenticity of the disk-shaped object by restricting the thickness of the inserted disk-shaped object is provided in the second disk-shaped object guiding path 5 composed of an inclined transfer rail 4 for guiding the inserted disk-shaped object in the direction inclined to the right, as shown in the figure, rather than in the first disk-shaped object guiding path 3, as in the conventional sorter.

The disk-shaped object thickness-restricting means 30 is provided on the upstream side of the second disk-shaped object guiding path 5, comes into contact with the inserted disk-shaped object, changes its position depending on the thickness of the disk-shaped object in the contact, and restricts the thickness of the inserted disk-shaped object. The structure thereof comprises, as shown in FIG. 2 which is a cross-sectional view along DD in FIG. 1, a lever 32 rotatably supported on a shaft 31 as a center on the rear surface of a main plate 6, an inclined guide 33 supported on the lower end of the lever 32, a compression spring 34 for constantly impelling the lever 32 in the counterclockwise direction about the shaft 31, and stopper means 35 for restricting the rotation of the inclined guide 33 through an angle exceeding a fixed rotation angle.

Figure 2:
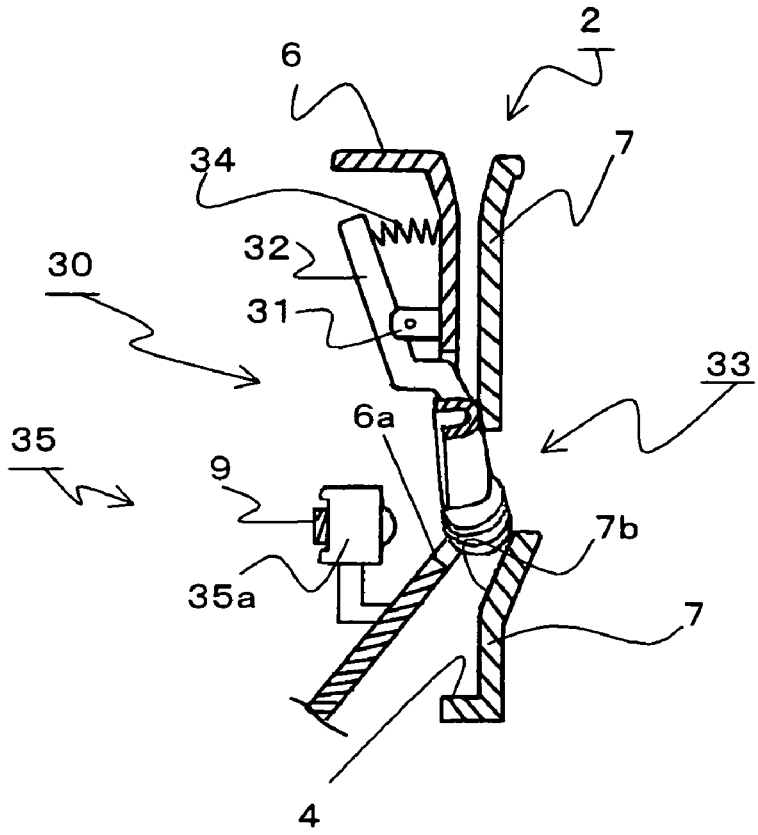
FIG. 2 is a cross-sectional view along DD in FIG. 1.
Figure 3:
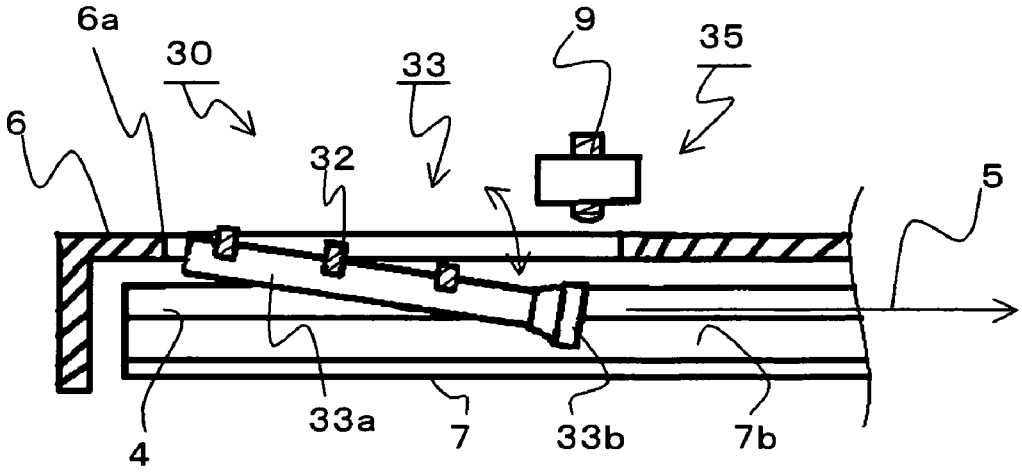
FIG. 3 is a cross-sectional view along EE in FIG. 1.

The aforementioned inclined guide 33, as shown in FIG. 2 and FIG. 3, which is a cross-sectional view along EE in FIG. 1, is free to move in and out of an orifice 6*a* formed in the front surface of the main plate 6 constituting one side surface of the second disk-shaped object guiding path 5 and in the initial position shown in FIG. 2 and FIG. 3, the inclined guide comes into contact with an inclined surface 7*b* of a gate plate 7 under the effect of the impelling force of the compression spring 34, and the movement thereof is thereby stopped and restricted.

The in-and-out movement of the inclined guide 33 may be also restricted on the side of the main plate 6.

Of the components of the above-described thickness-restricting means 30, the inclined guide 33 comprises, as shown in FIG. 3, a guide section 33*a* having a distal end gradually inclining toward the gate plate 7 in the downstream direction of the second disk-shaped object guiding path 5 and a board thickness restricting section 33*b* has a shape of an almost circular truncated cone supported on the distal end of the guide section 33*a*. The board thickness restricting section 33*a* is made of a metal.

Furthermore, as shown in FIG. 3, the stopper means 35 is provided in a position opposite the board thickness restricting section 33*b*, and this stopper means 35 comprises a thickness screw 9 screwed into a female threaded section 35*a* supported on the rear surface of the main plate 6, as shown in FIG. 2.

The operation of the above-described disk-shaped object sorter 20 will be explained below and the configuration thereof will be also explained below in greater detail.

Figure 4:
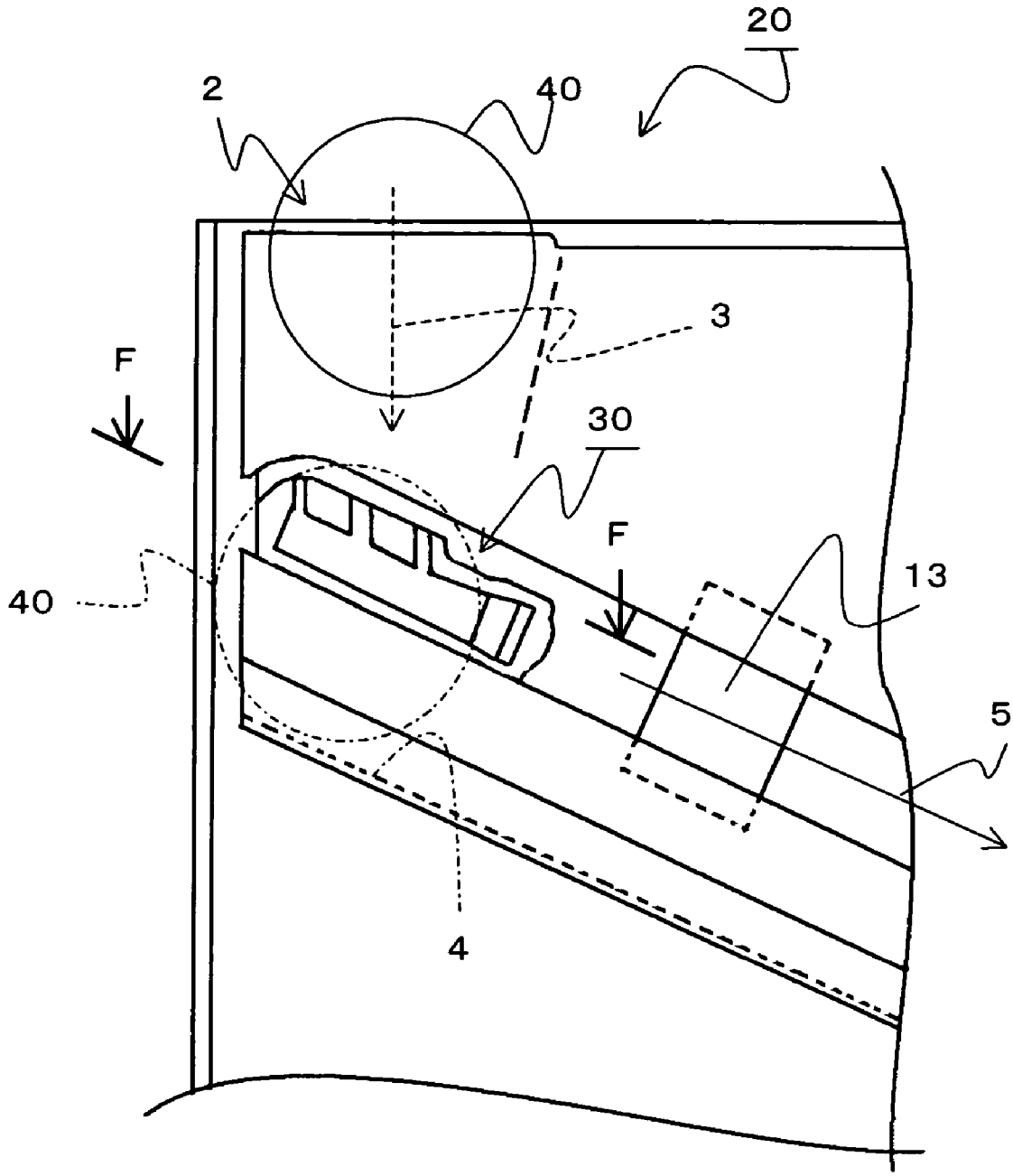
FIG. 4 is a main conceptual front view illustrating the operation of the disk-shaped object sorter in accordance with the present invention.

As shown in FIG. 4, if a disk-shaped object 40 with a diameter larger than the specified diameter for sorting objects is inserted with force into the disk-shaped object slot 2, this disk-shaped object 40 passes through the first disk-shaped object guiding path 3, collides with the inclined transfer rail 4 that constitutes the second disk-shaped object path and then faces the second disk-shaped object guiding path 5 with an inclined advancement direction.

Figure 5:
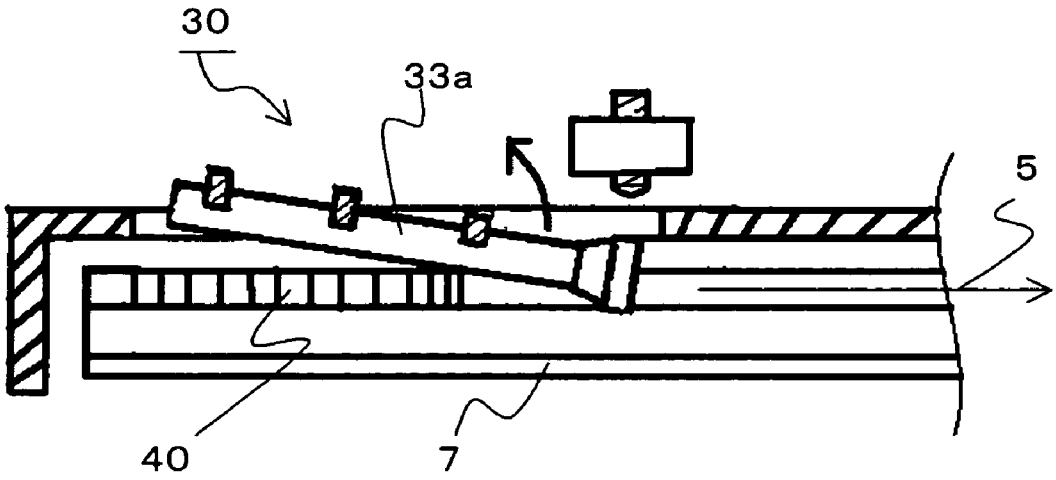
FIG. 5 is a cross-sectional view along FF in FIG. 4.

At this time, as shown in FIG. 5, which is a cross-sectional view along FF in FIG. 4, one side surface of the disk-shaped object 40 that was inserted with force and, therefore, moved vigorously is impelled by the impelling force of the inclined guide section 33*a* which is gradually pressed against it, that is, of the compression spring 34 (FIG. 2) and gradually pushed against the gate plate 7 by the impelling force of the inclined guide section 33*a* of the thickness-restricting means 30 supported so as to freely swing. As a result, vigorous movement, that is, vibrations of the disk-shaped object are absorbed and damped.

Figure 6:
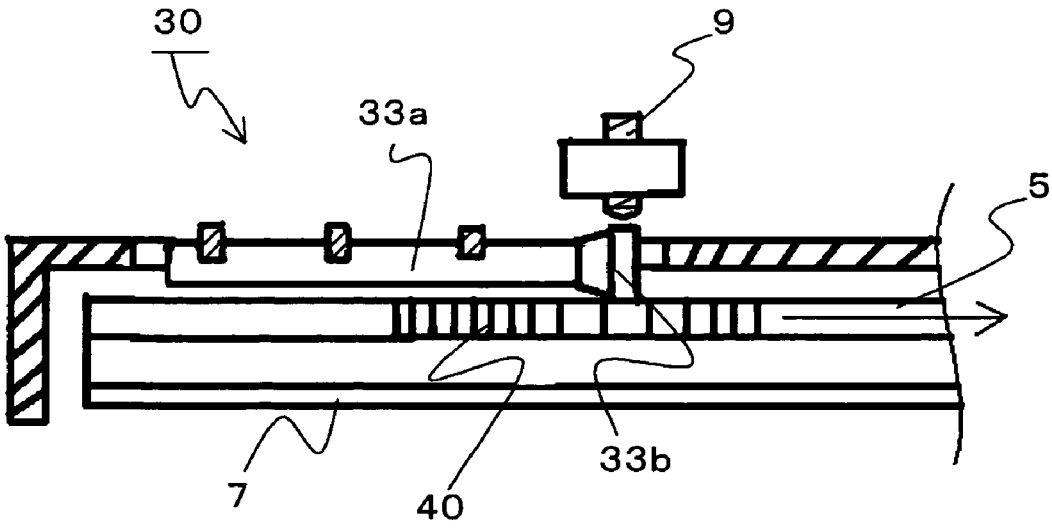
FIG. 6 is a cross-sectional view along FF in FIG. 4 illustrating the operation of the disk-shaped object sorter in accordance with the present invention.

If then the thickness of the inserted disk-shaped object 40 is less than the specified thickness, as shown in FIG. 6, the disk-shaped object is smoothly guided to the downstream of the second disk-shaped object path 5 through the inclined guide section 33*a* and board thickness restricting section 33*b* of the thickness-restricting means 30.

The authenticity of the inserted disk-shaped object 40 or the number of times the disk bodies passed are measured with the detection means 13 (FIG. 1) provided downstream thereof.

Figure 7:
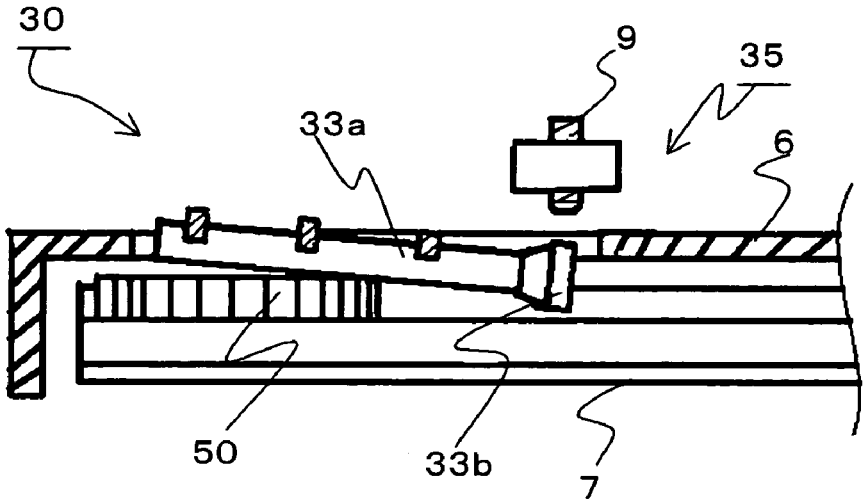
FIG. 7 is a cross-sectional view along FF in FIG. 4 illustrating the operation of the disk-shaped object sorter in accordance with the present invention.

On the other hand, as shown in FIG. 7, even when the disk-shaped object 50 with a diameter larger than the specified diameter and a thickness larger than the specified thickness is inserted with force into the disk-shaped object slot 2, the disk-shaped object 50 is gradually pushed against the gate plate 7 by the impelling force of the inclined guide section 33*a* that is gradually pressed against the side surface of the disk-shaped object 50 and vigorous movement of the disk-shaped object is absorbed.

Figure 8:
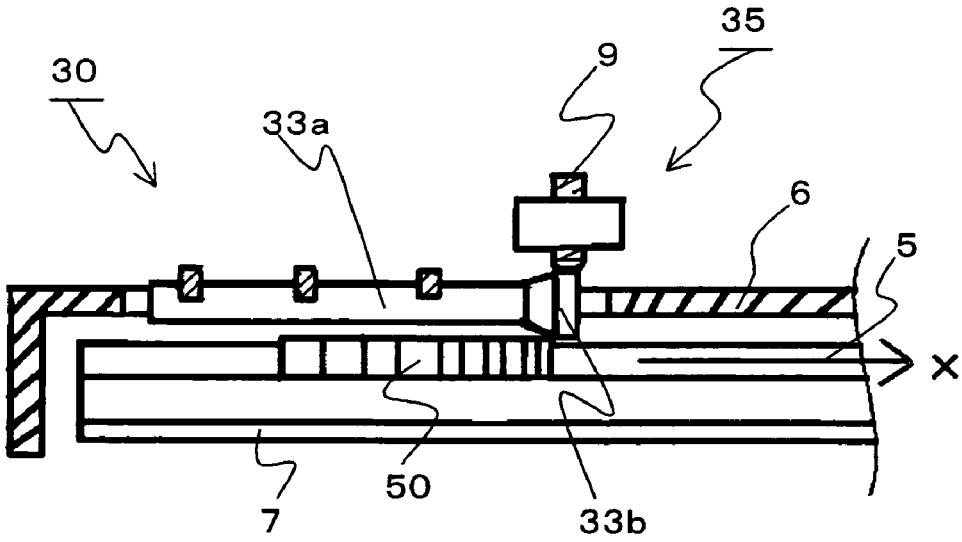
FIG. 8 is a cross-sectional view along FF in FIG. 4 illustrating the operation of the disk-shaped object sorter in accordance with the present invention.
Figure 9:
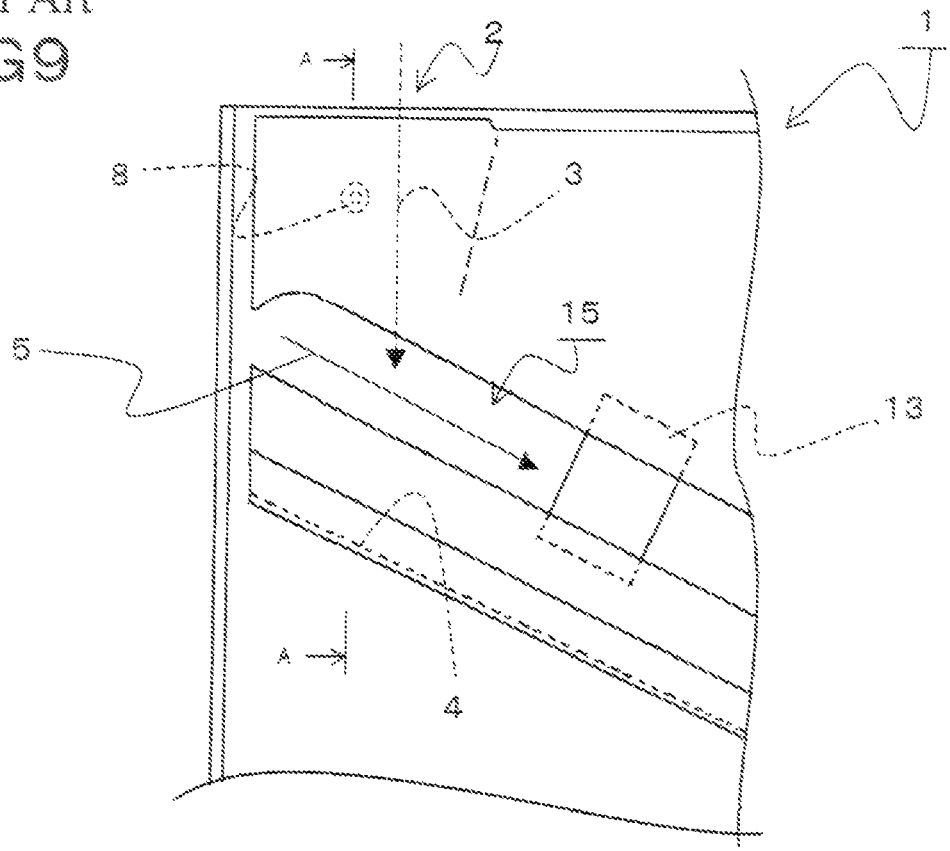
Prior Art FIG9
FIG. 9 is a conceptual front view of a main portion of a conventional disk-shaped object sorter.
Figure 10:
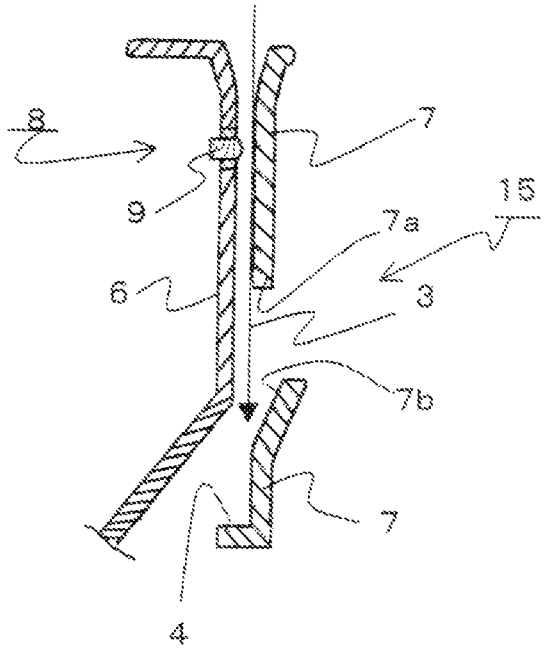
Prior Art FIG10
FIG. 10 is a cross-sectional view along AA in FIG. 9.
Figure 11:
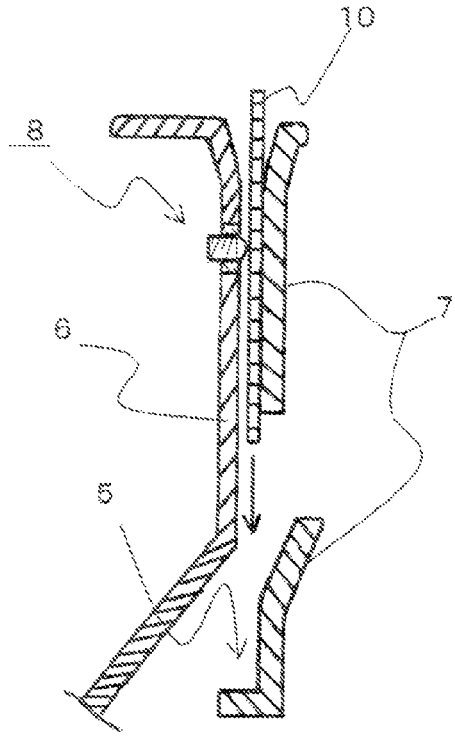
Prior Art FIG11
FIG. 11 is a main conceptual front view illustrating the operation of the conventional disk-shaped object sorter.

If the disk-shaped object 50, which has a thickness larger than the specified thickness and whose vigorous movement was thus absorbed, is guided downstream of the second disk-shaped object path 5 and comes into contact with the board thickness restricting section 33*b* of the inclined guide 33, as shown in FIG. 8, then the board thickness restricting section 33*b* comes into contact with the thickness screw 9 of the stopper means 35, thereby restricting the gap between the surface of the gate plate 7 and the board thickness restricting section 33*b* and reliably stopping the advance movement of the disk-shaped object 50, which has a thickness larger than the specified thickness.

It goes without saying that the gap between the board thickness restricting section 33*b* that came into contact with the thickness screw 9 and the surface of the plate 7 is formed equal to or somewhat larger than the thickness of the specified disk-shaped object.

Therefore, when the above-described board thickness restricting section 30 is used, even the energy of the disk-shaped object that was inserted with force and moved vigorously is gradually absorbed by the above-described thickness-restricting means 30. Therefore, the space between the thickness screw 9 of the stopper means 35 and the board thickness restricting section 33*b* is not enlarged by a vigorous movement of the disk-shaped object. As a result, the disk-shaped object that is the object of restriction is effectively prevented from being guided downstream of the disk-shaped object guiding path.

What is claimed is:

1. A disk-shaped object sorter comprising:

a disk-shaped object guiding path to transfer and guide a disk-shaped object inserted through a disk-shaped object slot;

a guide supported so as to freely swing in the disk-shaped object guiding path;

impelling means for impelling the guide to apply pressure with the guide to one side surface of the disk-shaped object passing through the disk-shaped object guiding path; and stopper means for restricting expansion of a gap between a side wall of the disk-shaped object guiding path and the guide by coming into contact with the guide when a disk-shaped object with a thickness larger than a specified thickness advances, and stopping the advancement of the disk-shaped object with a thickness larger than the specified thickness, wherein the guide composes:

a guide section with a distal end inclined gradually toward the disk-shaped object guiding path; and a board thickness restricting section supported on the distal end of the guide section, the board thickness restriction section being in the form of a circular truncated cone and made of metal.

* * * * *